United States Patent [19]

Fusco

[11] 4,183,113

[45] Jan. 15, 1980

[54] ROTARY SCRAPER

[76] Inventor: Robert Fusco, 4923 8th Ave., Brooklyn, N.Y. 11220

[21] Appl. No.: 867,603

[22] Filed: Jan. 6, 1978

[51] Int. Cl.[2] ..... A46B 5/06; A46B 13/02; A47L 13/06

[52] U.S. Cl. ..... 15/236 C; 15/198; 29/81 H

[58] Field of Search ..... 15/89, 91, 92, 198, 15/200, 104.14, 236 C; 17/64, 67; 125/5; 29/81 H

[56] References Cited

U.S. PATENT DOCUMENTS

| | | | |
|---|---|---|---|
| 462,157 | 10/1891 | Pederson | 125/5 |
| 1,107,354 | 8/1914 | Radlein et al. | 15/198 |
| 1,153,738 | 9/1915 | Devoorde | 15/104.14 |
| 1,694,018 | 12/1928 | Mudge et al. | 17/64 |

FOREIGN PATENT DOCUMENTS

| | | | |
|---|---|---|---|
| 530654 | 7/1931 | Fed. Rep. of Germany | 125/5 |
| 538416 | 11/1931 | Fed. Rep. of Germany | 15/198 |

*Primary Examiner*—Daniel Blum

[57] ABSTRACT

An improved rotary scraper having a central rotatable hub and a plurality of scraper members pivotally attached to said hub and extending outwardly therefrom for sliding engagement with and at an angle to a work surface is provided. The scraper members each comprise a coil spring disposed about a rod formed in the hub and a pair of generally parallel equal length spring fingers extending from the ends of said coil. During rotation, the scraper members are restrained in a position at an angle to the work surface by means of one finger of each pair bearing against the spring coil on an adjacent rod disposed in the hub. The finger which is restrained by the adjacent rod is stiffer than the other finger of the pair, which is restrained only by the coil, so that the degree of scraping action can be controlled by the pressure exerted upon the hub to bring the less stiff finger or both fingers into contact with the work surface. Operation in the reverse rotational direction serves to sharpen the ends of the fingers which become worn during use.

3 Claims, 2 Drawing Figures

ROTARY SCRAPER

BACKGROUND OF THE INVENTION

Rotary scraping devices having a central hub and a plurality of oxtwardly extending spring-like fingers for scraping engagement with a work surface are known in the art. A primary example for such device can be found in U.S. Pat. No. 3,958,294 to Thompson. The rotary scraper disclosed in the Thompson patent comprises a hub having a pair of spaced apart disc shaped plates connected by a plurality of rods, called pivot shafts, equally spaced along the outer periphery of the hub plates. The hub also includes a central drive shaft which interconnects the two hub plates and extends to the exterior thereof. Such shaft can be connected to a rotational drive means, such as a power drill, for imparting the necessary rotational movement to the hub.

Each pivotal shaft carries thereon a plurality of generally L-shape wire fingers wound by means of a coil thereabout. According to the Thompson patent a further series of rods, referred to as restraining shafts, are disposed between each of the pivot shafts to engage the inside end or short leg of each wire finger and thereby limit the arcuate travel of the outside ends (the scraper portion) of the wire fingers. In this manner, the wire fingers which extend exteriorly of the hub are restrained from extending into a radial position so that they must contact the work surface at an angle. In actual practice, the device manufactured by Thompson is somewhat different than that disclosed in his patent. In the actual device there are no restraining shafts per se, and the inner ends of the wire fingers are free to pivot between the central drive shaft, which serves as a common restraining shaft, and an adjacent pivot shaft. Since the wire fingers extend unsupported from their coils their flexibility or stiffness depends on the thickness of the material and strength of the spring coil. Thus, Thompson provides scrapers of different finger gauges for different purposes. According to Thompson the material to be removed from a surface is loosened by the striking of the fingers thereagainst rather than digging into the surface. The material is then lifted off by the unflexing of the finger as pressure is relieved by the rotary travel of the scraper.

While the concept of the Thompson rotary scraper is meritorious, the actual construction has several disadvantages, which impair its operation and limit its useful life. Although the wire fingers are pivotally movable, the limit of such pivotal movement is such that they are maintained within an angular range which permits rotation of the scraper in one direction only. If the device is used otherwise, it will cause extensive damage to the work surface through gouging. This is particularly true where a large gauge wire is utilized for the fingers.

In addition, it has been found that there is tendency for the wire fingers in the Thompson device to deform and bend out of shape through excessive use, where a high pressure is applied to the rotary scraper during use to remove material from or polish a particularly hard work surface.

Finally, and most importantly, the uses to which a Thompson scraper can be put depend to a great extent on the thickness or gauge of the fingers. Fine gauge fingers can not always be effectively used on hard work surfaces having difficult to remove material, and coarse gauge fingers tend to gouge or mar a relatively soft surface.

SUMMARY OF THE INVENTION

In accordance with the present invention, an improved rotary scraping device is provided which overcomes all of the deficiencies found in the aforementioned Thompson rotary scraper by permitting rotational operation in either the clockwise or counter-clockwise direction, by supporting the wire fingers in a manner which prevents their permanent deformation, and by providing wire fingers of a single gauge capable of treating both hard and soft surfaces.

The improvement which constitutes the present invention resides primarily in the construction of the wire fingers. Unlike prior devices in which the fingers were formed from wire spring material having a generally L-shape, wherein the long section of the L constitutes the wire finger and the short section of the L constitutes the inside end of the spring which prevents complete radial extension, the present wire fingers comprise a generally U-shaped spring in which both segments of the U extend outwardly from the hub of the device to form a double set of scraping fingers. The two legs or fingers of the U are connected by a coil which is disposed about suitable rods disposed within the hub. As the device is rotated, the trailing finger of each U contacts at a point along its length the surface of the immediately adjacent rod to restrain the entire U shaped spring in an angular position relative to the work surface. In so doing the flexibility or stiffness of the trailing finger contacting the adjacent rod is stiffer than the one that is restrained merely by spring tension since it flexes about its restraining point, and the shorter the extension of finger beyond such point, the stiffer it becomes. In this manner, by applying a light degree of pressure to the tool during rotation the leading more flexible fingers of each U contact the work surface to provide a smooth or fine finish to the work. Additional pressure causes the trailing or stiffer finger of each U to also contact the work surface for more heavy-duty applications. In addition, the U-shaped spring is not susceptible of permanent deformation under normal operation, since the pressure to deflect the leading finger beyond the distance of the two fingers of the U greatly increases once the trailing or stiffer finger comes into contact with the work surface.

Moreover, the use of the U-shaped springs doubles the number of fingers available to treat a work surface without increasing the overall size of the scraper, inasmuch as each spring includes two fingers rather than one. Thus, a finer or smoother finish can be obtained in many instances.

The U-shaped spring while not subjected to rotational forces is free to be pivotally moved from a position wherein one of the fingers contacts an adjacent rod to a position wherein the other finger contacts the other adjacent rod, so that the device is equally operational whether rotating in the clockwise or counter-clockwise direction. In this regard, it should be noted that continued operation in one rotational direction tends to dull the ends of the fingers. However, reversing the direction serves to sharpen such ends during use, unlike prior devices which require that the fingers be sharpened with a file or other sharpening devices.

In general, the rotary scraper of the invention comprises a hub having a pair of spaced apart disc shaped plates; a central drive shaft fixedly attached to said hubs adapted for connection to exterior rotational drive means; a plurality of equally spaced connecting rods fixedly attached to and extending between said plates along their outer periphery; and a plurality of scraper members pivotally attached to each of said connecting rods; said scraper members each comprising a U-shaped spring having a central coil disposed about one of said connecting rods, and a pair of outwardly extending spring fingers adapted for flexible sliding engagement with a work surface upon rotation of the hub; said fingers being restrained in an angular position relative to the work surface by the engagement of the trailing finger of each pair at a point along its length with the central coils of the U-shaped spring on the immediately adjacent connecting rod.

The flexibility of the scraper fingers depends upon several variables, such as the wire gauge, the number of coils, the length of each finger and the material. These parameters must be accounted for in designing a scraper for particular applications and will be known to those skilled in the art.

Similarly, the size of the hub and the number of connecting rods and scraper members provided in a rotary scraper in accordance with the invention can be varied to suit a multitude of various industrial and household applications. However, in the preferred embodiment the rotary scraper has been sized for use with a conventional, hand held power drill. For such use it has been found that a hub size of approximately two and one half (2½) to three and one half (3½) inches in diameter and a spring finger length of approximately three (3) to four (4) inches is satisfactory. Such diameter permits the placement of six (6) connecting rods within the hub to provide adequate spacing for the spring fingers and adequate support therefor to retain the same in the proper angular position relative to the work surface. It has been found that a distance of approximately one (1) inch between the discs of the hub permits each connecting rod to receive approximately five (5) scraper members and that such number results in satisfactory operation. Accordingly, in the preferred embodiment of the present invention approximately thirty (30) scraper members can be provided, each containing two (2) spring fingers for a total of sixty (60) fingers adapted to polish and finish a work surface.

The preferred embodiment of the invention is more fully described in the annexed drawings.

DETAILED DESCRIPTION OF PREFERRED EMBODIMENT

Figure 2:
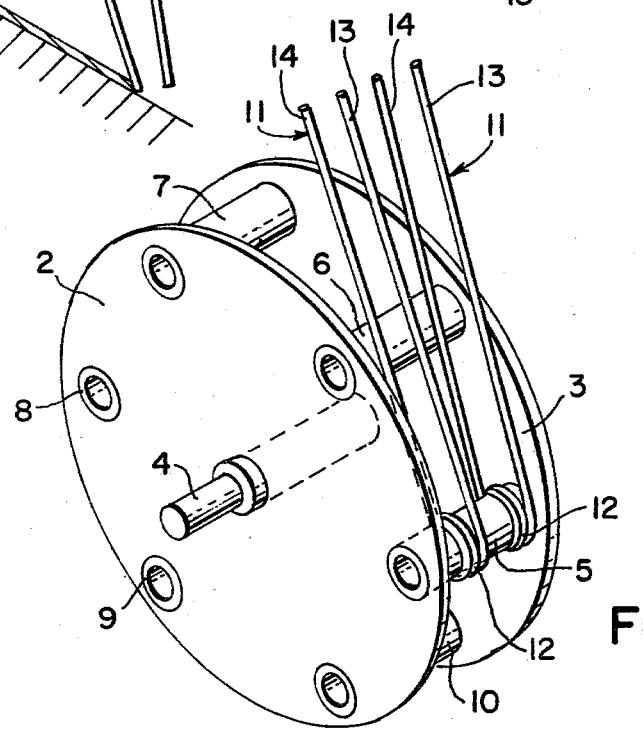
FIG. 2 is a partial perspective view of the rotary scraper illustrating the construction of the spring fingers.

Referring now to the drawings, in the preferred embodiment the rotary scraper of the invention comprises a hub having a pair of spaced apart disc shaped plates 2 and 3. A central drive shaft 4 is fixedly connected to both plates 2 and 3 and extends to the exterior of plate 2 for connection to an exterior rotational drive means (not shown) such as a conventional hand held power drill. A series of six equally spaced connecting rods 5 through 10 extend between plates 2 and 3 and are fixedly connected to both. The connecting rods serve to maintain plates 2 and 3 in a fixed spaced apart relationship and further serve as mounting means for scraper members 11. It is intended that five such scraper members 11 be pivotally disposed upon each such connecting rod. However, for illustrative purposes so that the scraper members may be clearly seen FIG. 2 shows connecting rod 5 containing only two of said scraper members.

Figure 1:
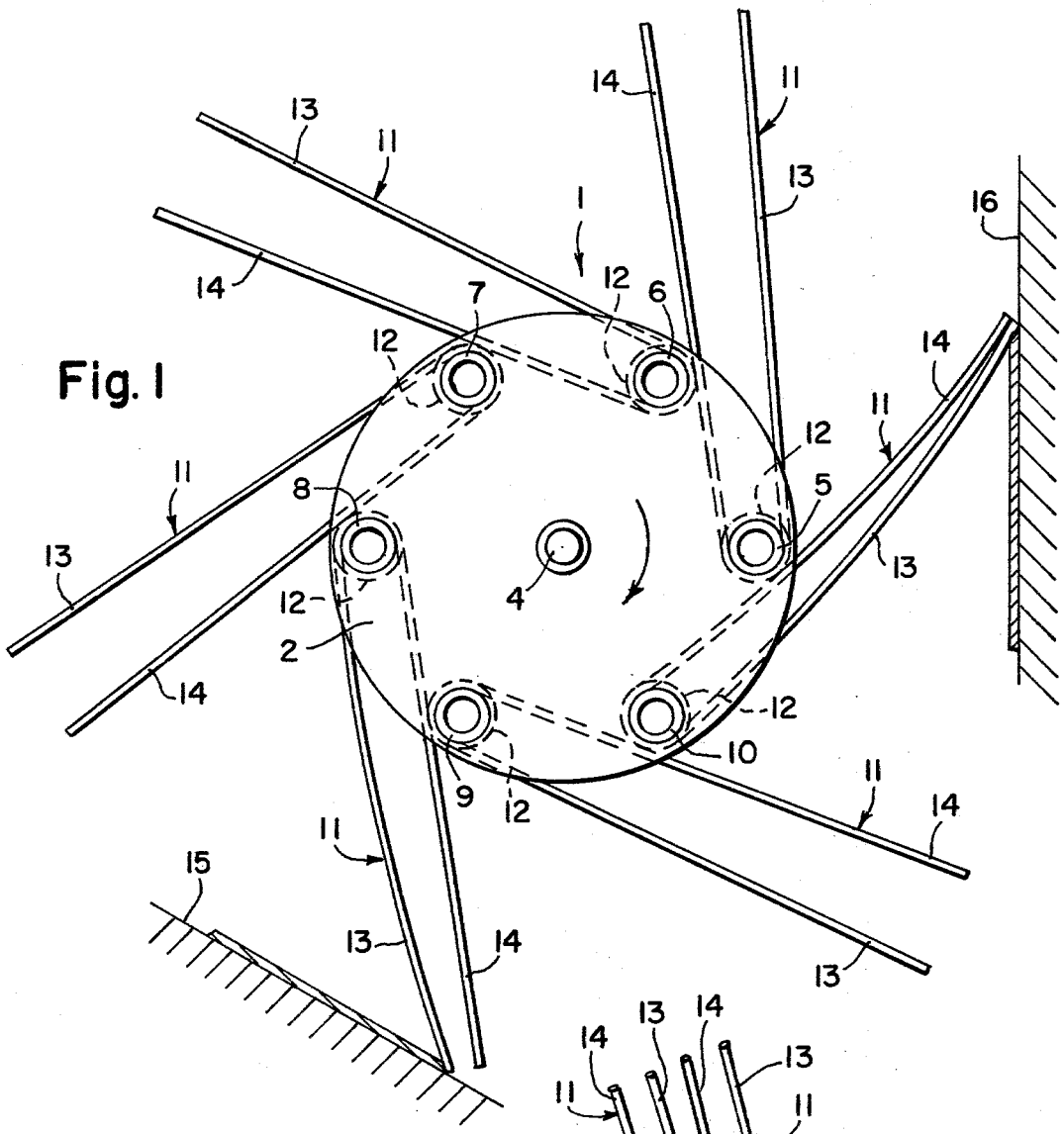
FIG. 1 is a side view of the rotary scraper of the invention shown in operation.

Each scraper member comprises a round wire U shaped spring having a central coil 12 disposed about one of the connecting rods and a pair of equal length outwardly extending spring fingers 13 and 14 adapted for flexible sliding engagement with a work surface illustrated at 15 and 16 in FIG. 1 upon rotation of the hub.

In order to obtain the proper flexing of the wire fingers 13 and 14 to achieve the desired scraping, cleaning or polishing of a work surface, the fingers must be restrained to contact the work surface at an angle thereto. This is accomplished in the present invention by the connecting rods. As the device is rotated in the direction of the arrow the trailing finger 14 of each U shaped scraper member contacts at a point along its length the surface of the coil 12 of the scraper member disposed upon the immediately adjacent connecting rod to restrain the entire U shaped spring in the angular position shown. It will be appreciated by those skilled in the art that by rotating the scraper in the direction opposite to that shown in FIG. 1 (i.e., counter-clockwise) finger 13 of each scraper member becomes the trailing finger and will be supported by the connecting rod on the opposite side to restrain the scraper members in the desired angular position relative to the work surface.

FIG. 1 illustrates two modes of operation of the rotary scraper of the invention. If we assume that work surface 15 is a material which can be easily scratched or marred, it is desirable that a light degree of pressure be applied thereto in order to scrape or clean the same, and that the wire fingers that contact such surface be relatively flexible. It can be seen in the lower part of FIG. 1 that the rotary scraper can be utilized by applying a light degree of pressure so that only the leading finger 13 of each scraper member contact the work surface 15. Such finger is more flexible than finger 14, since it is restrained only by the action of coil 12. On the other hand as illustrated in the upper right side of FIG. 1 where the work surface 16 is tougher or requires more force to remove a surface layer therefrom, additional pressure can be applied to the rotary scraper such that the leading finger 13 as well as the trailing finger 14 are both brought into contact with the work surface. The additional stiffness of the trailing finger provides extra force necessary to remove a tough coating material from the work surface.

Variations of the embodiment shown as well as other embodiments falling within the scope of this invention will be apparent to those skilled in the art.

What is claimed is:

1. A rotary scraper comprising a hub having a pair of spaced apart disc shaped plates; a central drive shaft fixedly attached to said hubs for connection to exterior rotational drive means; a plurality of equally spaced connecting rods fixedly attached to and extending between said plates along their outer periphery; and a plurality of round wire scraper members pivotally attached to each of said connecting rods; said scraper members each comprising a U-shaped spring having a central coil completely encircling one of said connecting rods and a pair of outwardly extending equal length, straight, parallel, spring fingers adapted for flexible sliding engagement with a work surface upon rotation of the hub; said fingers being restrained in an angular position relative to the work surface by the engagement of one finger of each pair at a point along its length with the central coil of each U-shaped spring disposed on the immediately adjacent connecting rod, so that the flexibility of said engaged finger of each pair is less than the flexibility of the unengaged finger of each pair to provide greater stiffness.

2. A rotary scraper in accordance with claim 1, in which the hub is selectively rotatable in either the clockwise or counter-clockwise direction.

3. A rotary scraper in accordance with claim 1, in which the more flexible fingers of each of said pairs are adapted to be brought into sliding engagement with the work surface for lightly treating the same, and the less flexible fingers of said pairs are adapted to be brought into contact with the work surface for heavy dury applications.

* * * * *